US008931509B2

(12) United States Patent
Beard

(10) Patent No.: US 8,931,509 B2
(45) Date of Patent: Jan. 13, 2015

(54) PRESSURE CORRECTING DISTRIBUTOR FOR HEATING AND COOLING SYSTEMS

(75) Inventor: Eli Beard, Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 686 days.

(21) Appl. No.: 13/268,162

(22) Filed: Oct. 7, 2011

(65) Prior Publication Data

US 2013/0087204 A1 Apr. 11, 2013

(51) Int. Cl.

*F25B 39/02* (2006.01)
*F25B 41/06* (2006.01)
*F28F 27/02* (2006.01)

(52) U.S. Cl.

CPC ..... *F25B 39/028* (2013.01); *F25B 2500/01* (2013.01)
USPC ..... 137/561 A; 62/525

(58) Field of Classification Search

USPC ..... 137/561 A; 62/525, 504; 165/173, 174, 165/175, 176, 178; 236/92 B
See application file for complete search history.

(56) References Cited

U.S. PATENT DOCUMENTS

| | | | | |
|---|---|---|---|---|
| 2,082,403 | A | 6/1937 | Larkin | |
| 2,144,898 | A | 1/1939 | Shrode | |
| 2,787,138 | A | 4/1957 | Boyle | |
| 2,803,116 | A | 8/1957 | Tilney | |
| 3,563,055 | A | 2/1971 | Owens | |
| 3,745,787 | A | 7/1973 | Ponziani | |
| 3,864,938 | A | 2/1975 | Hayes, Jr. | |
| 4,445,343 | A | 5/1984 | McCarty | |
| 4,513,587 | A * | 4/1985 | Humpolik et al. | 62/515 |
| 4,674,673 | A | 6/1987 | Parrish | |
| 6,059,026 | A | 5/2000 | Bailly et al. | |
| 2010/0115979 | A1 * | 5/2010 | Lee et al. | 62/259.1 |

(Continued)

FOREIGN PATENT DOCUMENTS

| | | | |
|---|---|---|---|
| DE | 4333421 | A1 | 4/1995 |
| EP | 0895051 | A1 | 2/1999 |
| EP | 1707902 | A2 | 10/2006 |

(Continued)

OTHER PUBLICATIONS

Foreign Communication from a Counter-Part Application, Partial European Search Report; European Application No. EP 12187374.9; Jan. 8, 2013; 5 pgs.
Parker, Sporlan, Engineering Your Success, Sporlan Refrigerant Distributors, Bulletin, 20-10, Feb. 2009, 22 pages.
Foreign Communication from a Counter-Part Application, Extended European Search Report; European Application No. EP 12187374.9; Apr. 22, 2013; 9 pgs.
PCT International Search Report; PCT Application No. PCT/US2012/059018; Mar. 12, 2013; 6 pgs.
PCT Written Opinion of the International Searching Authority; PCT Application No. PCT/US2012/059018; Mar. 12, 2013; 8 pgs.
Foreign Communication from a Counter-Part Application, PCT Invitation to Pay Additional Fees and, Where Applicable, Protest Fee; PCT Application No. PCT/US2012/059018; Jan. 2, 2013; 6 pgs.

*Primary Examiner* — Atif Chaudry
(74) *Attorney, Agent, or Firm* — Conley Rose, P.C.; J. Robert Brown, Jr.; Michael J. Schofield

(57) ABSTRACT

A distributor assembly has a distributor extending along a central axis between a first end and a second end opposite the first end. The distributor has a flow passage extending from the first end of the distributor and a plurality of feeder ports extending from the second end of the distributor to the flow passage and each feeder port is in fluid communication with the flow passage. Each feeder port extends along a central axis from a first end at the flow passage to a second end at the second end of the distributor and each feeder port comprises a first axial segment and a second axial segment, the first axial segment being connected between the flow passage and the second axial segment and the second axial segment being connected between the first axial segment and the second end of the distributor.

19 Claims, 6 Drawing Sheets

(56) References Cited

U.S. PATENT DOCUMENTS

| | | | | |
|---|---|---|---|---|
| 2010/0301865 | A1* | 12/2010 | Yamashita | 324/318 |
| 2010/0313585 | A1 | 12/2010 | Parker et al. | |

FOREIGN PATENT DOCUMENTS

| | | | |
|---|---|---|---|
| EP | 2184564 | A2 | 5/2010 |
| JP | 2000179968 | A | 6/2000 |

* cited by examiner

PRESSURE CORRECTING DISTRIBUTOR FOR HEATING AND COOLING SYSTEMS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

This disclosure relates generally to heating and cooling systems, and more particularly to a distributor assembly positioned between an expansion valve and a multi-circuit evaporator in a heating or cooling system. In a heat pump and refrigeration cycle, refrigerant alternately absorbs and gives up thermal energy as it circulates through the system and is compressed, condensed, expanded, and evaporated. In particular, a liquid refrigerant flows from a condenser, through an expansion device (e.g., expansion valve) and into an evaporator. As the refrigerant flows through the expansion device and evaporator, the pressure of the refrigerant decreases, the refrigerant phase changes into a gas, and the refrigerant absorbs thermal energy. From the evaporator, the gaseous refrigerant proceeds to a compressor, and then back to the condenser. As the refrigerant flows through the compressor and condenser, the pressure of the refrigerant increases, the refrigerant phase changes back into a liquid, and the refrigerant gives up thermal energy. The process is repeated to emit thermal energy into a space (e.g., heat a house) or remove thermal energy from a space (e.g., air condition a house).

Some conventional evaporators have a plurality of refrigerant flow paths or circuits, each flowing through a different portion of the evaporator. Such evaporators, referred to as multi-circuit evaporators, utilize a distributor device or assembly positioned upstream of the evaporator to divide and direct the flow of refrigerant from the expansion device into the plurality of circuits in the evaporator. The distributor assembly also functions to provide substantially equal distribution of gaseous and liquid refrigerant from the expansion device to each circuit of the evaporator and further to provide substantially even distribution of refrigerant to each of the evaporator circuits. Still further, the distributor assembly is configured to generate a pressure drop in the refrigerant flowing therethrough in route to the evaporator so that the pressure of the refrigerant continues to decrease and the refrigerant absorbs thermal energy, expands, and phase changes into a gas.

SUMMARY OF THE DISCLOSURE

In some embodiments of the disclosure, a distributor assembly is provided that comprises a distributor extending along a central axis between a first end and a second end opposite the first end. The distributor may comprise a flow passage extending from the first end of the distributor and a plurality of feeder ports extending from the second end of the distributor to the flow passage, each feeder port being in fluid communication with the flow passage. Each feeder port may extend along a central axis from a first end at the flow passage to a second end at the second end of the distributor and each feeder port may comprises a first axial segment and a second axial segment, the first axial segment being connected between the flow passage and the second axial segment and the second axial segment being connected between the first axial segment and the second end of the distributor.

In other embodiments of the disclosure, a distributor assembly is provided that comprises a distributor extending along a central axis between a first end and a second end opposite the first end, the distributor comprising. The distributor may comprise a flow passage extending from the first end of the distributor and a plurality of feeder ports extending from the second end of the distributor to the flow passage, each feeder port being in fluid communication with the flow passage. Each feeder port may comprises a first axial segment and a second axial segment, the first axial segment being connected between the flow passage and the second axial segment and the second axial segment being connected between the first axial segment and the second end of the distributor, and at least two of the first axial segments may comprise different first axial segment diameters.

In still other embodiments of the disclosure, a method of modifying refrigerant distribution through a distributor assembly is disclosed that comprises at least one of (1) increasing a feeder port diameter and increasing a length of an associated feeder conduit and (2) decreasing a feeder port diameter and decreasing a length of an associated feeder conduit.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Distributor assemblies sometimes comprise a distributor and a plurality of elongate feeder tubes extending from the distributor to the evaporator. In some applications, the distributor may divide the flow of refrigerant into multiple flow paths, and each feeder tube may direct refrigerant from one of the divided flow paths to one of the evaporator circuits. To achieve a desired pressure drop across the distributor assembly, some conventional feeder tubes are relatively long—about 30 in. (~0.76 m) long. Such relatively long feeder tubes may present design and servicing limitations since their size may limit the potential locations of certain components of the refrigeration system such as the distributor, the evaporator, etc. In addition, long feeder tubes may negatively impact access to other components of the system during servicing.

Accordingly, the present disclosure provides more compact distributor assemblies that enable a sufficient refrigerant pressure drop, provide a lower cost alternative to conventional distributor assemblies, and allow easier servicing of a refrigeration system comprising the more compact distributor assemblies.

Figure 1:
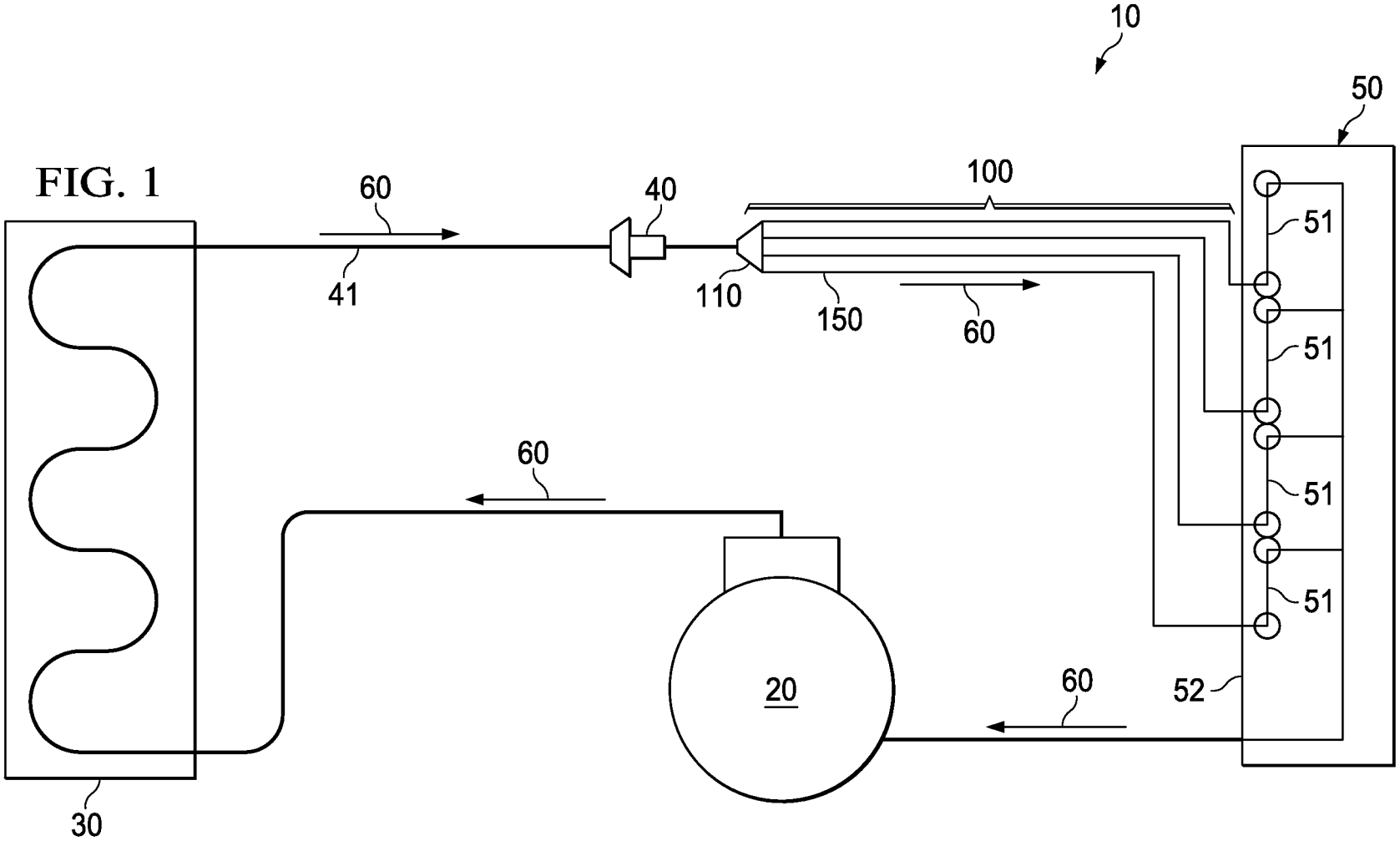
FIG. 1 is a simplified schematic view of a refrigeration system according to an embodiment of this disclosure.

Referring now to FIG. 1, a climate control system 10 is schematically shown. In general, system 10 may be used to manage and control the temperature of a space, such as the inside of a house, an office building, a vehicle cabin, etc. System 10 includes a compressor 20, a condenser 30 in fluid communication with compressor 20, an expansion device 40 in fluid communication with condenser 30, a distributor assembly 100 in fluid communication with expansion device 40, and a multi-circuit evaporator 50 in fluid communication with distributor assembly 100 and compressor 20. A fluid refrigerant (i.e., liquid and/or gas) represented by flow arrows 60, in some embodiments, circulates through system 10 flowing through compressor 20, condenser 30, expansion device 40, distributor assembly 100, and evaporator 50 back to compressor 20.

During each cycle, at least a portion of fluid refrigerant 60 may phase change from liquid to gas, or from gas to liquid. For example, in compressor 20, a substantially gaseous refrigerant 60 is compressed and pumped to condenser 30 where refrigerant 60 gives up thermal energy and condenses into a substantially liquid refrigerant 60. Thus, thermal energy is transferred from refrigerant 60 to the surrounding environment at condenser 30, thereby providing a heating effect at condenser 30. Liquid refrigerant 60 then flows from condenser 30 through expansion device 40 (e.g., an expansion valve) and distributor assembly 100 where it is expanded, undergoes a pressure reduction, and transitions into a mixed gaseous/liquid refrigerant 60. From distributor assembly 100, the mixed gaseous/liquid refrigerant 60 flows through evaporator 50 where refrigerant 60 absorbs thermal energy, and expands into a substantially gaseous refrigerant 60. Thus, thermal energy is transferred from the surrounding environment at evaporator 50 into refrigerant 60, thereby providing a cooling effect at evaporator 50. From evaporator 50, the substantially gaseous refrigerant 60 returns to the compressor 20 and the cycle repeats. It should be appreciated that system 10 is a closed-loop system, and thus, the mass flow rate of refrigerant 60 through any particular region of system 10 is substantially the same.

As described above, thermal energy is transferred from refrigerant 60 to the surrounding environment at condenser 30, and thermal energy is transferred from the surrounding environment to refrigerant 60 at evaporator 50. Depending on the location of evaporator 50 and condenser 30, system 10 may generally be used to provide heating or cooling. For example, system 10 may be arranged such that evaporator 50 absorbs heat from inside a house and gives up this absorbed heat outside through condenser 30, thereby providing air conditioning to the house. Alternatively, system 10 may be configured such that condenser 30 emits heat inside the house through condenser 30 and absorbs heat from outside the house through evaporator 50, thereby providing heat to the house. By inclusion of a reversing valve, the system shown in FIG. 1 (e.g., system 10) may alternatively be configured to selectively provide both heating and cooling to a particular space (i.e., configured as a heat pump in which the functions of the condenser 30 and the evaporator 50 may be reversed depending on whether heating or cooling is desired).

Figure 2:
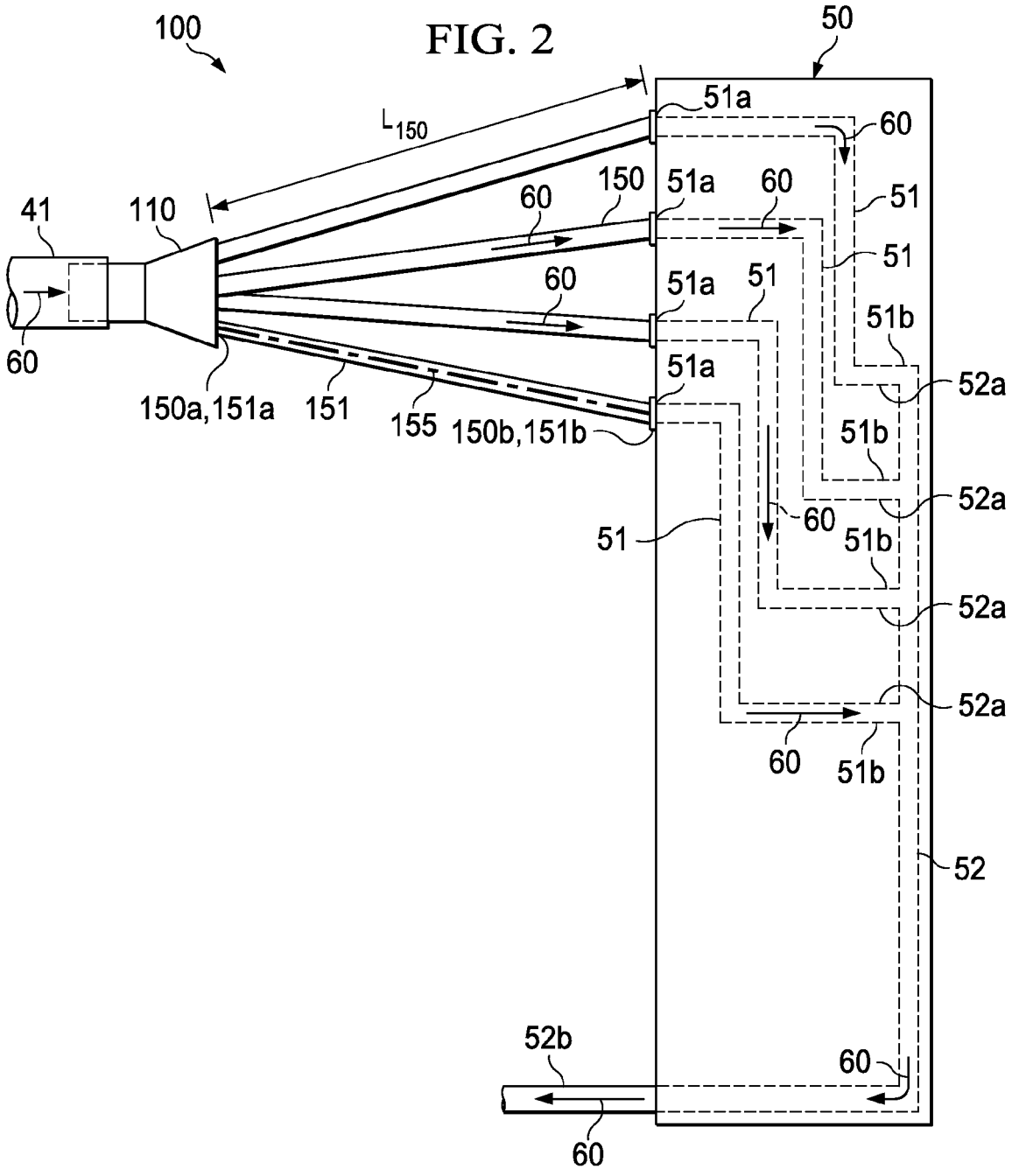
FIG. 2 is an a simplified schematic view of a distributor assembly and a multi-circuit evaporator of FIG. 1.

Referring now to FIGS. 1 and 2, in this embodiment, evaporator 50 is a multi-circuit evaporator including a plurality of internal flow passages or circuits 51. When refrigerant 60 flows from distributor assembly 100 through evaporator 50 to compressor 20 as shown in FIG. 1, each circuit 51 has an upstream inlet 51*a* and a downstream outlet 51*b*. Between inlets 51*a* and outlets 51*b*, refrigerant 60 flowing through each circuit 51 is separated from the refrigerant 60 flowing through the other circuits 51. In addition, evaporator 50 includes a discharge header 52 having a plurality of inlets 52*a* and an outlet 52*b* in fluid communication with compressor 20. Each circuit outlet 51*b* is in fluid communication with one of the header inlets 52*a*.

During operation of system 10, refrigerant 60 from distributor assembly 100 enters one of the plurality of circuits 51 at its corresponding inlet 51*a*, flows downstream through the circuit 51 to its outlet 51*b*, where it then flows into discharge header 52 through its corresponding header inlet 52*a*. Refrigerant 60 enters header 52 from all of the circuits 51, recombines, and flows downstream through header outlet 52*b* to compressor 20. Thus, refrigerant 60 flowing through each circuit 51 comes together and recombines in header 52, and then flows to compressor 20 via outlet 52*b*.

As best shown in FIG. 2, distributor assembly 100 includes a distributor 110 and a plurality of elongate feeder conduits 150, each conduit 150 extending between distributor 110 and evaporator 50. In this embodiment, each feeder conduit 150 is sized and configured substantially the same. In particular, each feeder conduit 150 has a central or longitudinal axis 155, a first or distributor end 150*a* attached to distributor 110, a second or evaporator end 150*b* attached to evaporator 50, and a central flow passage 151 extending between ends 150*a, b*. When refrigerant 60 flows through flow passage 151 of each feeder conduit 150 from distributor end 150*a* to evaporator end 150*b*, flow passage 151 defines a feeder conduit inlet 151*a* at distributor end 150*a* and a feeder conduit outlet 151*b* at evaporator end 150*b*. As will be described in more detail below, flow passage 151 of each feeder conduit is in fluid communication with a feeder port 130 of distributor 110 (FIGS. 3 and 4) and one evaporator circuit 51. Thus, in this embodiment, one feeder conduit 150 is provided for each outlet feeder port 130 of distributor 110, and one circuit 51 is provided for each feeder conduit 150.

Without being limited by this or any particular theory, an efficiency of the system (e.g., system 10) may be improved by (a) substantially evenly distributing the refrigerant across the plurality of feeder conduits of the distributor assembly (e.g., feeder conduits 150); (b) moving substantially the same mass flow rate of refrigerant through each feeder conduit; and (c) generating substantially the same pressure drop across each feeder conduit. Configuring and sizing each feeder conduit of the distributor assembly (e.g., each feeder conduit 150) substantially the same offers the potential to desirably achieve even distribution of refrigerant across the plurality of feeder conduits, uniform mass flow rate of refrigerant through each feeder conduit, and equal pressure drop across each feeder conduit. Accordingly, in some embodiments described herein, each feeder conduit of the distributor assembly (e.g., each feeder conduit 150) may be sized and configured substantially the same.

Referring still to FIG. 2, each feeder conduit 150 has a length $L_{150}$ measured parallel to its axis 155 between ends 150*a, b*. As noted above, in this embodiment, each feeder conduit 150 is sized and configured substantially the same, and thus, each feeder conduit 150 has substantially the same length $L_{150}$. In some embodiments, the length of each feeder conduit (e.g., length $L_{150}$ of each feeder conduit 150) may be between about 10 in. to about 30 in., and alternatively may be between about 15 in. to about 20 in.

Figure 4:
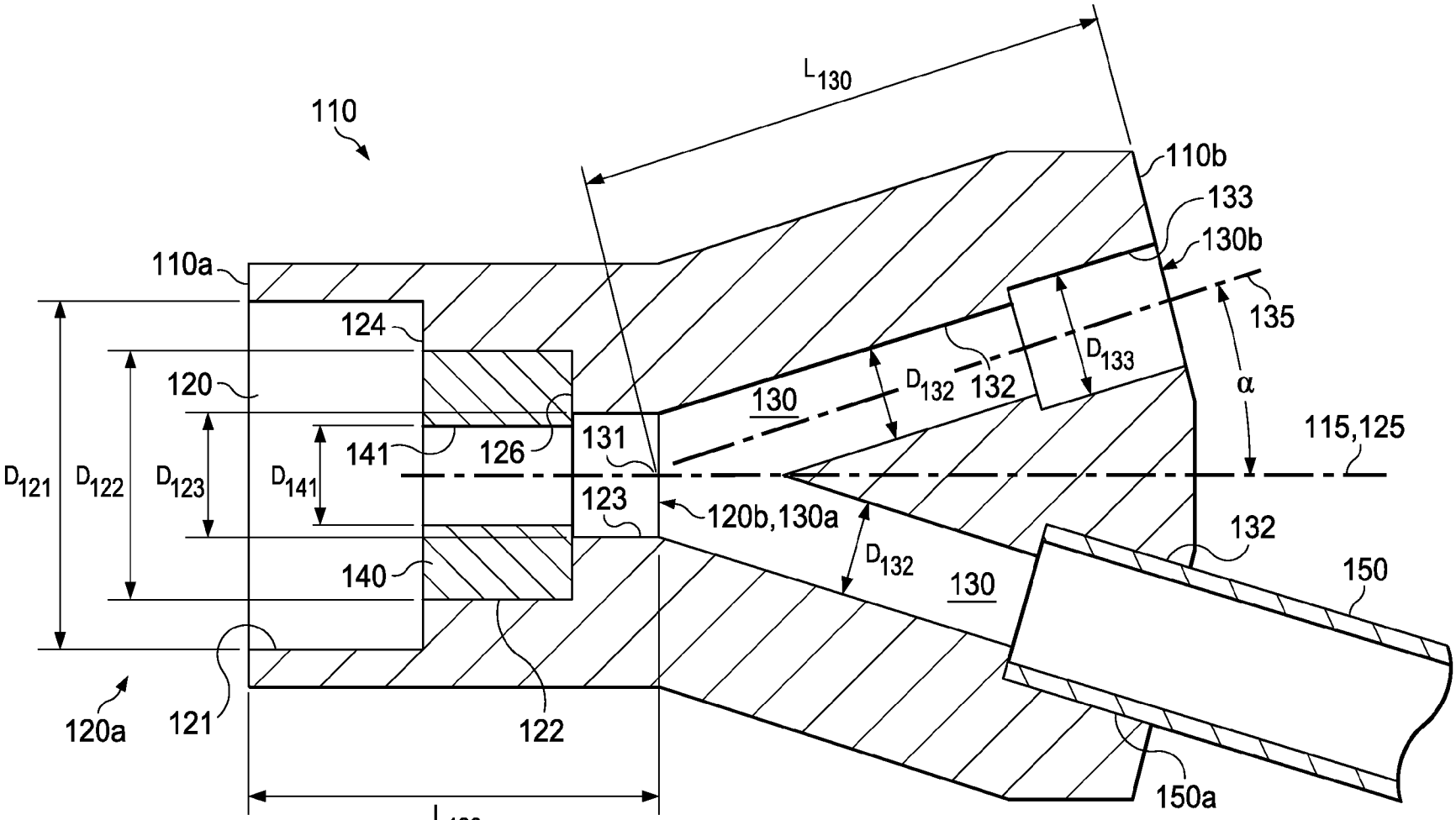
FIG. 4 is a partial cross-sectional side view of the distributor of FIGS. 2 and 3, taken along section lines 4-4 of FIG. 3.

In general, the feeder conduits (e.g., conduits 150) may comprise any suitable materials including, without limitation, metals and metal alloys (e.g., stainless steel, brass, copper, aluminum, etc.), non-metal (e.g., ceramic), or composite (e.g., carbon fiber substrate and epoxy matrix composite). However, in some embodiments, the feeder conduits 150 may comprise corrosion resistant material(s) suitable for use with compressed refrigerants such as brass, copper, or aluminum. Although feeder conduits 150 shown in FIGS. 2 and 4 are cylindrical tubes, in other embodiments, the feeder conduits may have different cross-sectional shapes (e.g., rectangular).

Referring now to FIGS. 1-4, distributor 110 extends along a central or longitudinal axis 115 between a first or inlet end 110*a* and a second or outlet end 110*b*. Inlet end 110*a* is coupled to refrigerant pipe 41 and the plurality of feeder conduits 150 are coupled to and extend from outlet end 110*b*. As shown in FIGS. 1 and 2, pipe 41 supplies refrigerant 60 to distributor assembly 100 and distributor 110 from condenser 30. In this embodiment, inlet end 110*a* of distributor 110 is sized and configured to be received by the end of pipe 41. Distributor 110 may be coupled to the end of pipe 41 in any suitable manner including, without limitation, welding, brazing, adhesive, mating threads, or combinations thereof.

Referring still to FIGS. 1-4, distributor 110 also includes inlet flow passage 120 extending axially (relative to axis 115) from first end 110*a* and a plurality of feeder ports 130 extending from inlet flow passage 120 to second end 110*b*. Inlet flow passage 120 has a central or longitudinal axis 125 coincident with axis 115, a first end 120*a* at first end 110*a* of distributor 110 and a second end 120*b* at its intersection with feeder ports 130. When refrigerant 60 flows through distributor 110 from first end 110*a* to second end 110*b* as shown in FIG. 1, first end 120*a* of inlet flow passage 120 may be described as an "inlet," and second end 120*b* of inlet flow passage 120 may be described as an "outlet."

Each feeder port 130 has a central or longitudinal axis 135, a first end 130*a* at its intersection with inlet flow passage 120, and a second end 130*b* at second end 110*b* of distributor 110. When refrigerant 60 flows through distributor 110 from first end 110*a* to second end 110*b* as shown in FIG. 1, first end 130*a* of each feeder port 130 may be described as an "inlet," and second end 130*b* of each feeder port may be described as an "outlet."

Figure 3:
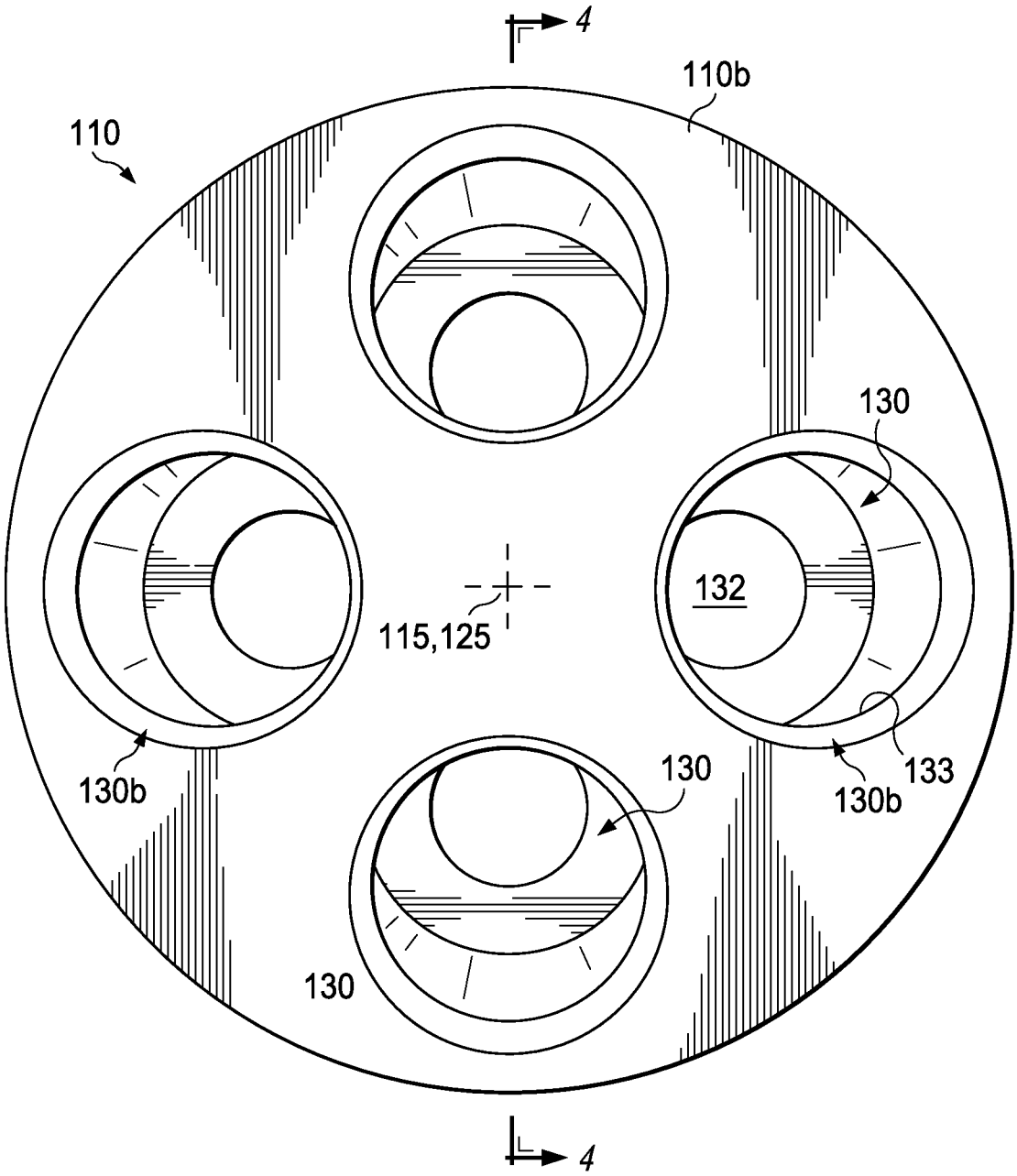
FIG. 3 is an end view of the distributor of FIG. 2.

First ends 130*a* of all the feeder ports 130 converge at second end 120*b* of inlet flow passage 120, and central axis 135 of each outlet feeder port 130 intersects at a common point 131 disposed on axes 115, 125. Further, as best shown in FIG. 3, second ends 130*b* of feeder ports 130 are substantially uniformly circumferentially spaced about axis 115.

Without being limited by this or any particular theory, an efficiency of the system (e.g., system 10) may be improved by (a) substantially evenly distributing the refrigerant across the plurality of feeder ports of the distributor (e.g., feeder ports 130 of distributor 110); (b) moving refrigerant at substantially the same mass flow rate through each feeder port; and (c) generating substantially the same pressure drop across each feeder port. Configuring, orienting, and sizing each feeder port of the distributor substantially the same offers the potential to achieve these performance characteristics. Accordingly, in some embodiments, each feeder port 130 may be configured and sized substantially the same.

Referring specifically to FIG. 4, each feeder port 130 is oriented at an acute angle $\alpha$ relative to axes 115, 125. For a given outlet feeder port 130, angle $\alpha$ is the angle measured between axes 115, 125 and axis 135 when viewed perpendicular to a plane containing axes 115, 125 and axis 135. In this embodiment, each feeder port 130 is oriented at substantially the same angle $\alpha$ measured between axes 115, 125 and axis 135 when viewed perpendicular to a plane containing axes 115, 125 and axis 135. In some embodiments, angle $\alpha$ for each outlet feeder port 130 may be an acute angle between about 10° to about 45° and alternatively between about 15° to about 20°. In general, the orientation angle of the feeder ports 130 (e.g., angle $\alpha$ of feeder ports 130) may be varied as needed to accommodate different numbers of feeder ports 130 and the desired circumferential spacing of the outlet ends of the feeder ports 130 (e.g., outlets 130*b* of feeder ports 130).

Referring still to FIG. 4, inlet flow passage 120 has a length $L_{120}$ measured parallel to axis 125 from first end 120*a* to second end 120*b* at the intersection of axis 125 and axis 135. In other words, length $L_{120}$ is measured parallel to axis 125 from first end 120*a* to point 131. In some embodiments, the length of the inlet flow passage of the distributor 110 (e.g., the length $L_{120}$ of inlet flow passage 120) may be between about ⅛ in. to about 3 in., and alternatively between about ¼ in. to about ⅜ in.

Each feeder port 130 has a length $L_{130}$ measured parallel to its axis 135 from its first end 130*a* at the intersection of axis 135 and axes 115, 125 to its second end 130*b*. In other words, length $L_{130}$ of each feeder port 130 is measured parallel to its axis 135 from point 131 to its second end 130*b*. As noted above, in this embodiment, each feeder port 130 is configured and sized substantially the same, and thus, each feeder port 130 has substantially the same length $L_{130}$. In some embodiments, the length of each feeder port of the distributor (e.g., the length $L_{130}$ of each feeder port 130) may be between about ⅛ in. to about ½ in., and alternatively between about 0.2 in. to about 0.3 in.

In the embodiment shown in FIG. 4, inlet flow passage 120 is defined by a series of axial counterbores formed in distributor 110 and an annular flow restrictor 140 disposed within distributor 110. In this embodiment, three counterbores, 121, 122, and 123, are positioned between ends 120*a, b*. A first counterbore 121 extends axially (relative to axes 115, 125) from first end 120*a* of inlet flow passage 120 to a second counterbore 122. A second counterbore 122 extends axially (relative to axes 115, 125) from the first counterbore 121 to a third counterbore 123. The third counterbore 123 extends axially (relative to axes 115, 125) from second end 120*b* of inlet flow passage 120 to second counterbore 122. First counterbore 121 has a diameter $D_{121}$, second counterbore 122 has a diameter $D_{122}$ that is less than diameter $D_{121}$, and third counterbore 123 has a diameter $D_{123}$ that is less than diameter $D_{122}$. Each diameter $D_{121}$, $D_{122}$, $D_{123}$ is measured perpendicular to axes 115, 125. While each of the counterbores sets comprising counterbores 121, 122, and 123 may be substantially equal so that the various inlet flow passages 120 are substantially similar, in alternative embodiments, the counterbores 121, 122, and 123 may vary amongst the various inlet flow passages 120.

Referring still to FIG. 4, cylindrical flow restrictor 140 has substantially the same axial length (relative to axes 115, 125) as second counterbore 122 and is coaxially disposed in second counterbore 122. Flow restrictor 140 comprises a central throughbore or orifice 141 coaxially aligned with counterbores 121, 122, 123 and inlet flow passage 120. In this embodiment, orifice 141 has a diameter $D_{141}$ (measured perpendicular to axes 115, 125) that is less than diameters $D_{121}$, $D_{122}$, $D_{123}$. In general, the orifice diameter (e.g., diameter $D_{141}$) may be less than or equal to the smallest diameter of the inlet flow passage (e.g., diameter $D_{123}$ of counterbore 123 of inlet flow passage 120). Flow restrictor 140 generally axially abuts shoulder 126.

In this embodiment, flow restrictor 140 is coupled to distributor 110 via an interference fit. However, in general, flow restrictor 140 may be coupled to distributor 110 within second counterbore 122 in any suitable manner including, without limitation, press fit, adhesive, brazing, welding, threaded, machined, and/or or combinations thereof. Due to the reduced diameter of orifice 141, and substantially constant mass flow rate through system 10, as refrigerant 60 flows through flow restrictor 140, refrigerant velocity generally increases and refrigerant pressure generally decreases as compared to the velocity and pressure of refrigerant immediately upstream of the orifice 141.

Due to the differences in diameters $D_{121}$ and $D_{122}$ and diameters $D_{121}$ and $D_{141}$, an annular shoulder 124 is formed in inlet flow passage 120 at the intersection of counterbores 121, 122. The abrupt change in the internal diameter of inlet flow passage 120 at shoulder 124 and flow restrictor 140 offers the potential to increase the turbulence of refrigerant flow through inlet flow passage 120, in some cases, increasing mixing of the liquid and gaseous phases of refrigerant 60 passing through inlet flow passage 120 and eventually into feeder ports 130. Without being limited by this or any particular theory, increased turbulence and mixing of refrigerant 60 flowing through inlet flow passage 120 may provide for more even distribution of refrigerant 60 among feeder ports 130.

Referring now to FIGS. 3 and 4, as previously described, each feeder port 130 extends between first end 130*a* at its intersection with inlet flow passage 120 and second end 130*b* at second end 110*b* of distributor 110. In this embodiment, each feeder port 130 comprises a first or reduced diameter axial segment 132 and a second or increased diameter axial segment 133. First axial segment 132 extends axially (relative to axis 135) from first end 130*a* to second axial segment 133, and second axial segment 133 extends axially (relative to axis 135) from second end 130*b* to first axial segment 132. First axial segment 132 has a substantially constant or substantially uniform diameter $D_{132}$. As noted above, in this embodiment, each feeder port 130 is configured and sized substantially the same, and thus, diameter $D_{132}$ of first axial segment 132 of each feeder port 130 is substantially the same. In some embodiments, diameter $D_{132}$ of first axial segment 132 of each feeder port 130 may be less than or equal to 0.125 in. (⅛"), and alternatively between about 0.046875 in. (3/64") to about 0.125 in. (⅛").

Second axial segment 133 of each feeder port 130 has a substantially constant or substantially uniform diameter $D_{133}$ that is greater than diameter $D_{132}$. Consequently, the second axial segment 133 and second end 130*b* may also be referred to as forming a "counterbore" extending axially from distributor end 110*b*. As noted above, in this embodiment, each feeder port 130 is configured and sized substantially the same, and thus, diameter $D_{133}$ of second axial segment 133 of each feeder port 130 is substantially the same. Second axial segment 133 of each feeder port 130 is adapted to receive end 150*a* of one of the feeder conduits 150. As best shown in FIG. 4, diameter $D_{133}$ is substantially the same or slightly larger than the outer diameter of end 150*a* of its corresponding feeder conduit 150, and diameter $D_{132}$ may be smaller than the inner diameter of end 150*a* of its corresponding feeder conduit 150. Thus, there may be a drop in pressure and associated increase in velocity of refrigerant as it passes through first axial segment 132.

In general, each feeder conduit 150 may be coupled to its corresponding second axial segment 133 in any suitable manner including, without limitation, welding, brazing, mating threads, machining, etc. The connection between each second axial segment 133 and feeder conduit 150 may form a generally annular substantially fluid tight seal, thereby preventing refrigerant leaks and/or loss of refrigerant 60 flowing through distributor assembly 100.

Referring again to FIGS. 2-4, in this embodiment, one feeder conduit 150 is provided for each distributor feeder port 130 and one evaporator circuit 51 is provided for each feeder conduit 150. Thus, the number of feeder ports 130 in distributor 110 is substantially the same as the number of feeder conduits 150, which in turn is substantially the same as the number of circuits 51 in evaporator 50. In this embodiment, distributor assembly 100 includes four feeder conduits 150, evaporator 50 includes four circuits 51, and distributor 110 includes four feeder ports 130. However, in other embodiments, the distributor assembly (e.g., assembly 100), the evaporator (e.g., evaporator 50), and the distributor (e.g., distributor 110) may have any suitable number of feeder conduits (e.g., feeder conduits 150), circuits (e.g., circuits 51), and feeder ports (e.g., feeder ports 130), respectively, although the number of feeder conduits, circuits, and feeder ports in the distributor may be substantially the same (i.e., one feeder conduit is provided for each feeder port, and one evaporator circuit is provided for each feeder conduit). The number of feeder conduits, feeder ports, and circuits may be varied depending on a variety of factors including, without limitation, the application (e.g., residential, commercial, etc.), the volume or size of space to be climate controlled (e.g., number of cubic feet), the desired amount of air conditioning capacity (e.g., number of tons and/or BTUs of the heating and/or cooling capacity), the desired pressure drop across the distributor assembly (e.g., assembly 100), and/or combinations thereof.

In general, the distributor (e.g., distributor 110) may comprise any suitable material(s) including, without limitation, metals and metal alloys (e.g., stainless steel, aluminum, etc.), non-metal (e.g., ceramic), and/or composite (e.g., carbon fiber substrate and epoxy matrix composite). In some embodiments, the distributor 110 may comprise corrosion resistant material(s) suitable for use with compressed refrigerants such as aluminum and/or stainless steel.

In some embodiments, the feeder conduits 150 of the distributor assembly 100 may be significantly shorter than some conventional feeder conduits. In particular, some conventional feeder conduits have a length of about 30 in. In comparison, the length of some feeder conduits 150 of some embodiments of this disclosure may comprise a length $L_{150}$ of each feeder conduit 150 that may be between about 10 in. to about 20 in., and alternatively between about 12 in. to about 15 in. However, it will be appreciated that if a feeder conduit of a conventional distributor assembly 100 were simply shortened, an overall pressure drop across the distributor assembly 100 would decrease. This disclosure provides systems and methods for maintaining an overall pressure drop across a distributor assembly 100 having shortened feeder conduits 150 as compared to conventional feeder conduits. In some embodiments, an overall pressure drop across the entire distributor assembly 100 is achieved and/or maintained in spite of having substantially shorter feeder conduits 150 (as compared to conventional feeder conduits) by selectively reducing a diameter of a feeder port 130.

Referring again to FIG. 4, in some embodiments, a distributor assembly 100 may accommodate shorter feeder conduits 150 without impacting an overall pressure drop across the distributor assembly 100 by reducing the diameters $D_{132}$ of first axial segments 132 of feeder ports 130. Such a reduction in the diameters $D_{132}$ may be selected and/or determined so that the reductions in $D_{132}$ increases an overall pressure drop across the distributor assembly 100 substantially that is equivalent to any reduction in overall pressure drop of the distributor assembly 100 attributable to the feeder conduits 150 having shorter lengths $L_{150}$. In some embodiments described herein, the diameter of the first or reduced diameter segment of each feeder port (e.g., diameter $D_{132}$ of first axial segment 132) may be less than or equal to about 0.125 in., and alternatively between about 0.046875 in. (3/64") to about 0.125 in. (1/8").

Figure 5:
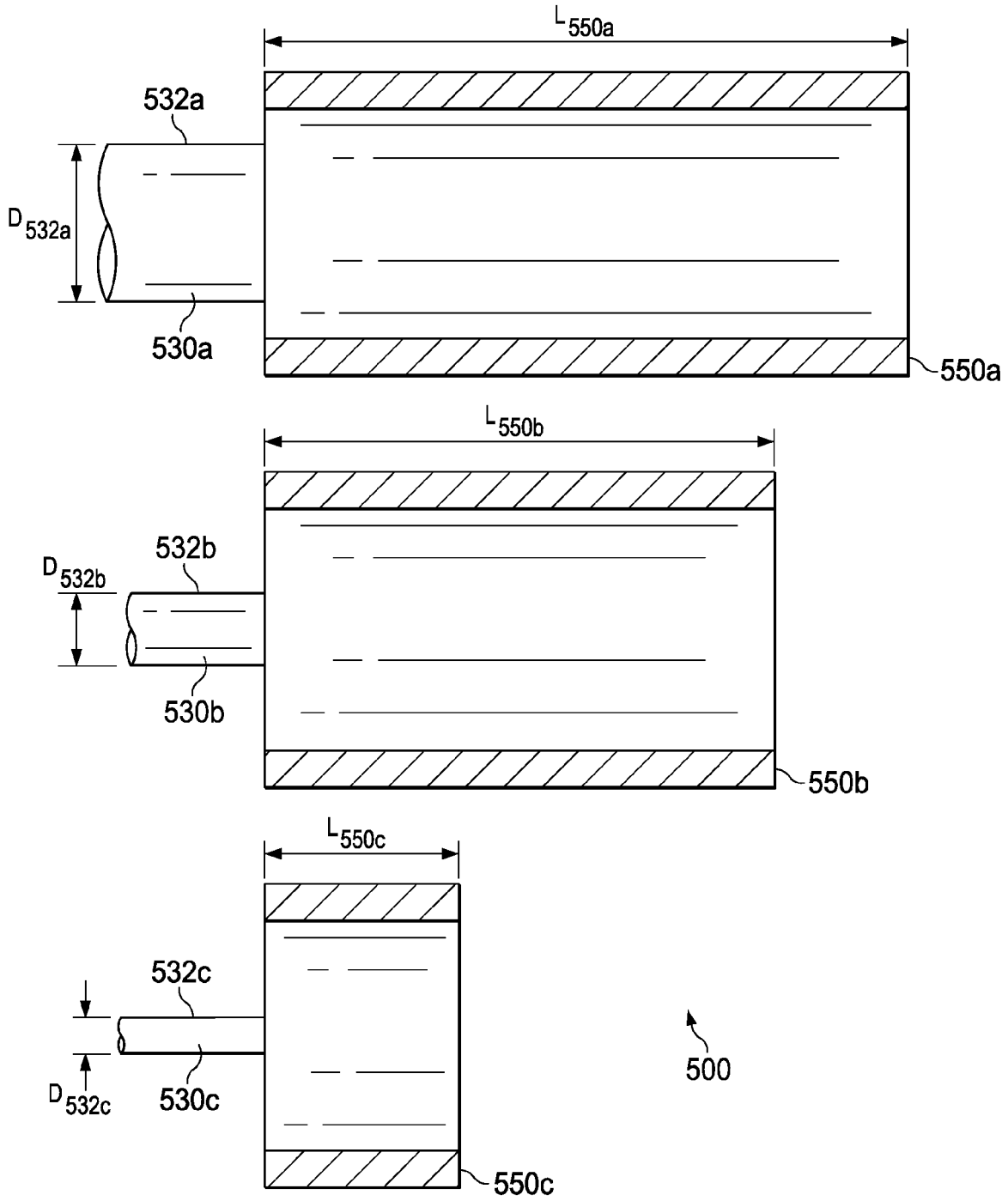
FIG. 5 is a schematic diagram of an alternative embodiment of a pressure correcting distributor assembly of the disclosure.

Referring now to FIG. 5, a simplified schematic representation of an alternative embodiment of a pressure correcting distributor assembly 500 is shown. Pressure correcting distributor assembly 500 is substantially similar to distributor assembly 100 with the exceptions that distributor assembly 500 comprises three feeder ports 530 rather than four feeder ports, each of the first axial segments 532 of feeder ports 530 comprise different diameters, and the feeder conduits 550 have different lengths $L_{550}$. More specifically, because first axial segment 532*a* of feeder port 530*a* comprises a relatively larger diameter $D_{532a}$ as compared to the other feeder ports 530, the feeder port 530*a* is coupled and/or associated with a feeder conduit 550*a* having a relatively longer length $L_{550a}$. Similarly, because second axial segment 532*b* of feeder port 530*b* comprises a relatively smaller diameter $D_{132b}$ as compared to $D_{532a}$, the feeder port 530*b* is coupled and/or associated with a feeder conduit 550*b* having a relatively shorter length $L_{550b}$ as compared to length $L_{550a}$. Further, because third axial segment 532*c* of feeder port 530*c* comprises a relatively smaller diameter $D_{132c}$ as compared to $D_{532b}$, the feeder port 530*c* is coupled and/or associated with a feeder conduit 550*c* having a relatively shorter length $L_{550c}$ as compared to length $L_{550b}$. In some embodiments, the pressure drop across each pair of the above-described feeder ports 530 and associated feeder conduits 550 may be substantially equal so that a mass flow rate of refrigerant delivered through each feeder conduit 550 is substantially the same. Accordingly, the distributor assembly 500 may be well suited for using just enough feeder conduit material to make the fluid connections between, for example, but not limited to, the distributor 510 and the multiple circuits of an evaporator.

Figure 6:
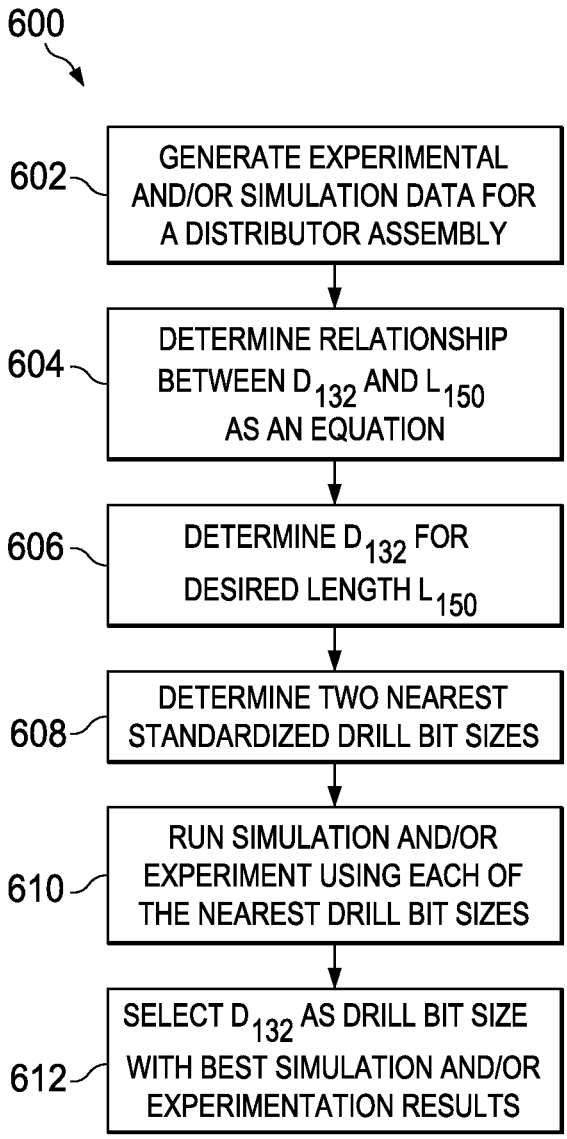
FIG. 6 is a flowchart of a method of constructing a distributor assembly and a method of modifying distribution of refrigerant through a distributor assembly.

Referring now to FIG. 6, flowchart of a method 600 of constructing a distributor assembly is shown. In some embodiments, the flowchart of FIG. 6 may also be referred to as a method of modifying distribution of refrigerant through a distributor assembly. It will be appreciated that various software simulator programs may be used to simulate HVAC system performance according to so-called performance models that comprise simulations elements representative of the features and/or components of the distributor assembly 100 as well as other elements of an HVAC system. In some simulator programs, assumptions and/or criteria such as mass flow rate of refrigerant and other operating conditions and/or physical component sizing may be specified and held constant. In some cases, by holding many of the variables constant and only selectively changing particular ones of simulation parameters, such as, but not limited to, component dimensions, relative simulation performance results may be compared to determine an effect of having changed a simulation parameter. Accordingly, this disclosure contemplates utilizing HVAC operation simulation software to study a conventional and/or existing design of a distributor assembly 100 to determine a functional relationship between diameters $D_{132}$ and lengths $L_{150}$.

More specifically, the method 600 may begin at block 602 by first analyzing an existing distributor assembly 100 configuration (either experimentally or through simulation) to gather data related to a functional relationship between diameters $D_{132}$ and lengths $L_{150}$ for a particular distributor assembly 100. In some embodiments, the data may be gathered as the result of noting system performance differences caused by at least one of selectively altering a diameter $D_{132}$ and/or a length $L_{150}$. In some embodiments, each of the lengths $L_{150}$ may be altered by a same amount while keeping diameters $D_{132}$ constant. Alternatively, in some embodiments, the lengths $L_{150}$ may be altered by different amounts while keeping diameters $D_{132}$ constant. Still further, in other embodiments, each of the diameters $D_{132}$ may be altered by a same amount while keeping lengths $L_{150}$ constant. Alternatively, in some embodiments, the diameters $D_{132}$ may be altered by different amounts while keeping constant lengths $L_{150}$.

Regardless of how the functional relationship between diameters $D_{132}$ and lengths $L_{150}$ are determined, at block 604, mathematical regression techniques may be used to produce a second-order polynomial equation that defines a relationship between diameters $D_{132}$ and lengths $L_{150}$. In some embodiments, an equation may take the form of: $D_{132}=a+b*L_{150}$, where the variables "a" and "b" are determined as a result of the above-described regression applied to the simulation and/or experimentation test results. In alternative embodiments, other regression techniques and/or methods may be used to generate relationships and/or equations of lesser or greater order (i.e., first degree polynomial equations, third degree polynomial equations, fourth degree polynomial equations, etc.).

Once the above-described equation has been generated, at block 606, a particular desired length $L_{150}$ may be used in the above-described equation to determine an appropriate diameter $D_{132}$ for use in designing a customized distributor assembly 100. It will be appreciated that a distributor assembly 100 comprising the particular desired length $L_{150}$ and the appropriate diameter $D_{132}$ would result in a distributor assembly 100 that generates substantially the same total pressure differential across the conventional distributor assembly studied above in block 602. Accordingly, by altering the conventional distributor assembly studied above in block 602 and mathematically modeled in block 604 to have the particular desired length $L_{150}$ and the associated calculated appropriate diameter $D_{132}$, a conventional distributor assembly that is normally restricted to operation with lengths $L_{150}$ may customized to have any desired lengths $L_{150}$ without incurring substantial detriments to operation.

While the above-described diameter $D_{132}$ may be the preferred diameter $D_{132}$, there is a high likelihood that the diameter determined above is not one that is easily implemented in a manufacturing environment. Accordingly, at block 608, the two nearest standardized drill bit sizes may be determined, regardless of systems of measurement (i.e., ANSI drill bit sizes, ISO metric drill sizes, and/or other).

Next, at block 610, the above-described desired length $L_{150}$ in a first one of the two nearest standardized drill bit sizes may be used in the above-described simulation and/or experimental test setup to determine system performance results. Also block 610, a second one of the two nearest standard size drill bit sizes may be used in the above-described simulation and/or experimental test setup to determine another set of system performance results.

At block 612, a customized distributor assembly 100 may reliably be produced by selecting the one of the two nearest standardized drill bit sizes described above it has resulted in most desirable performance results.

In a first example of implementing blocks 606-612, a functional relationship between diameter $D_{132}$ and length $L_{150}$ may have been determined as: $D_{132}=0.0958+0.000997*L_{150}$ from performance of blocks 602-604. Accordingly, at block 606, where a desired length $L_{150}$ is 15 in., the 15 in. value may be used in the above equation to determine that $D_{132}$=0.110755 in. Next at block 608, because 0.110755 in. is not a standardized drill bit size, the two nearest drill bit sizes may be determined by determining the two nearest drill bit ANSI and ISO size. Particularly, with $D_{132}$=0.110755 in., the value is bracketed by ANSI drill bit sizes #35 and #34, having sizes of 0.11 in. and 0.111 in., respectively. Similarly, with $D_{132}$=0.110755 in., the value is bracketed by ISO drill bit sizes 2.8 mm and 2.9 mm, equating to sizes of 0.1102 in. and 0.1142 in., respectively. Accordingly, $D_{132}$=0.110755 in. is most closely bracketed from below by the ISO drill bit size of 2.8 mm (with a difference of 0.000555 in.) and from above by the ANSI drill bit size #34 (with a difference of 0.000245 in.). Next, the 0.1102 in. and 0.111 in. values are substituted for the previously determined $D_{132}$=0.110755 in. in the system performance evaluations of block 610. After comparing the performance results obtained at block 610, at block 612, $D_{132}$ may be finally selected as the drill bit size yielding the most desirable performance results. The following table further demonstrates the relationship between diameter $D_{132}$ and length $L_{150}$ according to the equation of this example.

| $L_{150}$ in. | $D_{132}$ in. |
|---|---|
| 30 | 0.126 |
| 29 | 0.125 |
| 28 | 0.124 |
| 27 | 0.123 |
| 26 | 0.122 |
| 25 | 0.121 |
| 24 | 0.120 |
| 23 | 0.119 |
| 22 | 0.118 |
| 21 | 0.117 |
| 20 | 0.116 |
| 19 | 0.115 |
| 18 | 0.114 |
| 17 | 0.113 |
| 16 | 0.112 |
| 15 | 0.111 |
| 14 | 0.110 |
| 13 | 0.109 |
| 12 | 0.108 |
| 11 | 0.107 |
| 10 | 0.106 |

In other embodiments, alternative equations may be produced in blocks 602 and 604. For example, the relationship between diameter $D_{132}$ and length $L_{150}$ may be determined to be $D_{132}=-0.0630+0.000946*L_{150}$, or alternatively, $D_{132}=0.0816+0.00158*L_{150}$, among others. In determining the above equations, in some embodiments, some parameters of operation and/or simulation may generally be held constant amongst various experimental and/or simulation scenarios. For example, a mass flow rate of refrigerant may be held substantially constant at 100 lb/hr per each refrigerant circuit 51. Also, an internal diameter of feeder conduits may be held constant.

This disclosure contemplates providing distributor assemblies comprising different numbers and sizes of feeder ports and/or feeder conduits. Further this disclosure demonstrates that, in some embodiments, an overall pressure drop across a distributor assembly may be maintained in spite of the use of shorter feeder conduits and that overall pressure drop may be maintained by generating an internal pressure drop within the distributor to compensate for the loss in pressure drop attributable to the use of shorter feeder conduits. The use of feeder ports having reduced diameters in conjunction with feeder conduits having decreased lengths may provide a distributor assembly that may allow a reduced size and/or cost of manufacturing the distributor assembly. In some embodiments, reducing the length of the feeder conduits may reduce material costs to manufacture the distributor assembly while also providing a smaller distributor assembly. Further, one or more of the features and/or components of the distributor assemblies disclosed herein may comprise a so-called venturi profile, such as, but not limited to orifice 141 of flow restrictor 140. For example, in some alternative embodiments, the distributor may comprise a venturi profile comprising an initially large but decreasing diameter mouth. In some cases, a large chamfered interior wall of the distributor may transition to a curved or "bell-mouthed" wall and the walls may be formed integrally with a body of the distributor. Other alternative embodiments may comprise a sharp edged orifice. In some cases, a sharp edged orifice may comprise a thin plate with a small clean hole drilled through the thin plate. The sharp edged orifice may restrict flow regardless of fluid viscosity so that fluids of varying temperature and viscosity are restricted in substantially the same manner.

In some embodiments, a conventional distributor assembly may be retrofitted in accordance with the method of FIG. 6. In cases where a conventional distributor assembly comprises an existing $D_{132}$ smaller than a $D_{132}$ associated with a desired $L_{150}$, the existing diameter may be enlarged using the appropriate drill bit size determined at block 612. In cases where a conventional distributor assembly comprises an existing $D_{132}$ greater than a $D_{132}$ associated with a desired $L_{150}$, a tubular reducer, in some embodiments, comprising a metallic cylindrical tube, may be inserted into the port to reduce the effective diameter of the port through which refrigerant may travel.

Although climate control system 10 has been shown and described primarily from the perspective of an air conditioning system (i.e., to provide cooling to a space), embodiments of the distributor assembly (e.g., distributor assembly 100) and the distributor (e.g., distributor 110) described herein may be used in any suitable refrigerant based heating and/or cooling climate control systems. For example, the components shown in FIG. 1 may alternatively be arranged to provide heating and/or the system shown in FIG. 1 may be configured as a heat pump by inclusion of a reversing valve.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A distributor assembly, comprising:

a distributor extending along a central axis between a first end and a second end opposite the first end, the distributor comprising:

a flow passage extending from the first end of the distributor and a plurality of feeder ports extending from the second end of the distributor to the flow passage, each feeder port being in fluid communication with the flow passage;

wherein each feeder port extends along a central axis from a first end at the flow passage to a second end at the second end of the distributor;

wherein each feeder port comprises a first axial segment and a second axial segment, the first axial segment being connected between the flow passage and the second axial segment and the second axial segment being connected between the first axial segment and the second end of the distributor; and wherein the length of each first axial segment is substantially the same and wherein at least two of the plurality of feeder ports comprise different first axial segment diameters.

2. The distributor assembly according to claim 1, wherein the plurality of feeder ports are located in a substantially evenly distributed angular array.

3. The distributor assembly according to claim 1, wherein a diameter of the first axial segment is less than a diameter of the second axial segment.

4. The distributor assembly according to claim 1, wherein at least one of the first segment and the second segment are configured to receive a feeder conduit.

5. The distributor assembly according to claim 1, further comprising:

at least one of a venturi profile and sharp edged orifice associated with the flow passage.

6. The distributor assembly according to claim 1, further comprising:

a feeder conduit received within a feeder port.

7. The distributor assembly according to claim 6, wherein the feeder conduit comprises an internal diameter greater than a diameter of an associated first axial segment.

8. The distributor assembly according to claim 6, further comprising:

a plurality of feeder conduits, at least two of the plurality of feeder conduits comprising different feeder conduit lengths.

9. A distributor assembly, comprising:

a distributor extending along a central axis between a first end and a second end opposite the first end, the distributor comprising:

a flow passage extending from the first end of the distributor and a plurality of feeder ports extending from the second end of the distributor to the flow passage, each feeder port being in fluid communication with the flow passage;

wherein each feeder port comprises a first axial segment and a second axial segment, the first axial segment being connected between the flow passage and the second axial segment and the second axial segment being connected between the first axial segment and the second end of the distributor; and wherein at least two of the first axial segments comprise different first axial segment diameters and wherein the at least two of the first axial segments comprise substantially the same length.

10. The distributor assembly according to claim 9, further comprising:

a first feeder conduit received within a first of the plurality of feeder ports; and a second feeder conduit received within a second of the plurality of feeder ports;

wherein a diameter of the first feeder port is greater than a diameter of the second feeder port and wherein a length of the first conduit is greater than a length of the second feeder conduit.

11. The distributor assembly according to claim 10, wherein a pressure drop measured across an inlet to the first feeder port and an outlet of the first feeder conduit is substantially similar to a pressure drop measured across an inlet to the second feeder port and an outlet of the second feeder conduit.

12. The distributor assembly according to claim 10, wherein an inner diameter of a feeder conduit is greater than a diameter of an associated feeder port.

13. The distributor assembly according to claim 9, further comprising:

three feeder ports, none of the first axial segment diameters being equal.

14. The distributor assembly according to claim 9, further comprising:

at least one of a venturi profile and sharp edged orifice associated with the flow passage.

15. A method of modifying refrigerant distribution through a distributor assembly, comprising:

without altering a distance of any lengthwise segment of a feeder port, at least one of (1) increasing the feeder port diameter and increasing a length of an associated feeder conduit and (2) decreasing the feeder port diameter and decreasing a length of an associated feeder conduit.

16. The method of claim 15, further comprising:

increasing a first feeder port diameter and increasing a length of an associated first feeder conduit; and increasing a second feeder port diameter and increasing a length of an associated second feeder conduit.

17. The method of claim 16, wherein the increased first feeder port diameter is greater than the increased second feeder port diameter.

18. The method of claim 17, wherein the increased length of the first feeder conduit is greater than the increased length of the second feeder conduit.

19. The method of claim 18, further comprising:

passing refrigerant through at least one of a venturi profile and sharp edged orifice associated with the flow passage of the distributor assembly.

* * * * *